US006701727B2

(12) United States Patent
Komatsu et al.

(10) Patent No.: US 6,701,727 B2
(45) Date of Patent: Mar. 9, 2004

(54) APPARATUS AND METHOD FOR MANAGING HEAT SOURCE UNIT FOR AIR CONDITIONER

(75) Inventors: Tomohiro Komatsu, Tsuchiura (JP); Tadakatsu Nakajima, Tsuchiura (JP); Akira Nishiguchi, Tsuchiura (JP); Tatsuo Fujii, Tsuchiura (JP); Masaru Noujyo, Tsuchiura (JP); Kyoichi Sekiguchi, Chiyoda-ku (JP); Kenji Machizawa, Chiyoda-ku (JP); Yoshikazu Hanawa, Chiyoda-ku (JP); Tomio Nakajima, Chiyoda-ku (JP); Haruo Nashimoto, Chiyoda-ku (JP)

(73) Assignee: Hitachi Building Systems Co., Ltd., Tokyo (JP)

( * ) Notice: Subject to any disclaimer, the term of this patent is extended or adjusted under 35 U.S.C. 154(b) by 0 days.

(21) Appl. No.: 10/268,100

(22) Filed: Oct. 10, 2002

(65) Prior Publication Data

US 2003/0079483 A1 May 1, 2003

(30) Foreign Application Priority Data

Oct. 12, 2001 (JP) ..... 2001-315318

(51) Int. Cl.[7] ..... F25B 15/00; G01K 13/00

(52) U.S. Cl. ..... 62/148; 129/238.3

(58) Field of Search ..... 62/148, 141, 142, 62/126, 129, 238.3, 476, 478

(56) References Cited

U.S. PATENT DOCUMENTS 6,293,114 B1 * 9/2001 Kamemoto ..... 62/129

FOREIGN PATENT DOCUMENTS

JP 07151416 A * 6/1995 ..... F25B/15/00

* cited by examiner

*Primary Examiner*—Chen-Wen Jiang
(74) *Attorney, Agent, or Firm*—Crowell & Moring LLP

(57) ABSTRACT

A management apparatus and a management method which can forecast inspection time before the lowering of performance or the occurrence of abnormality in a heat source unit for an air conditioner are provided. The operating condition of the air conditioner heat source unit is monitored by a central monitoring unit of the management apparatus connected to the heat source unit through an information communication network. Operating data of the heat source unit is analyzed so that the lowering of the performance and the advance of the degree of abnormality in the heat source unit are diagnosed. Thus, the loss of a user caused by the failure stop or the performance lowering of the heat source unit is reduced. Further, the load on the heat source unit is grasped by the central monitoring unit so that remote central control is carried out to make the operating cost minimal.

15 Claims, 8 Drawing Sheets

| | |
|---|---|
| MANAGEMENT NUMBER | OOOOOO |
| CUSTOMER NAME | Mr.xxx |
| MODEL | ΔΔΔΔΔΔ |
| SERIAL NUMBER | □□□□□□ |
| DIAGNOSIS DATE | yyyymmdd |
| RECOMMENDED MAINTENANCE TIME | yyyymm |
| MAINTENANCE CONTENTS | 1. REPLACEMENT (PERIODIC)<br>2. ADJUSTMENT (PERIODIC)<br>3. ◇◇◇ EXECUTION (ADDITIONAL) |

MANAGEMENT NUMBER ○○○○○○
CUSTOMER NAME Mr.xxx
MODEL △△△△△△
SERIAL NUMBER □□□□□□
DIAGNOSIS DATE yyyymmdd
RECOMMENDED
MAINTENANCE TIME yyyymm
MAINTENANCE CONTENTS 1. REPLACEMENT (EXTRA)

APPARATUS AND METHOD FOR MANAGING HEAT SOURCE UNIT FOR AIR CONDITIONER

BACKGROUND OF THE INVENTION

1. Field of the Invention

The present invention relates to an apparatus and a method for managing a heat source unit for an air conditioner.

2. Description of the Related Art

For example, the invention disclosed in Japanese Patent Laid-Open No. 26237/1997 is known as a remote central control method for a heat source unit for an air conditioner. According to this invention, a terminal unit is installed in an absorption chiller/heater. Then, by use of signals indicating physical quantities or operating states of respective portions of the absorption chiller/heater, abnormality is judged in an arithmetic control portion provided in the terminal unit. When abnormality is detected, a signal stored in the terminal unit is transmitted to a central monitoring unit. In an analyzing computer provided in the central monitoring unit, deeper analysis is carried out while an indication is made on a monitor portion provided in the central monitoring unit or a warning light is lit.

In addition, Japanese Patent Laid-Open No. 151416/1995 discloses an absorption chiller/heater in which only pollution of cooling water likely to persist for a long time can be judged accurately. FIG. 6 is a diagram showing the configuration of a typical double-effect type absorption refrigerator disclosed in Japanese Patent Laid-Open No. 151416/1995. In this double-effect type absorption refrigerator, an absorption refrigerator is used as a heat source unit for an air conditioner implemented conventionally. In FIG. 6, an upper body 601, a lower body 602, a high temperature regenerator 603, a high temperature heat exchanger 604, a low temperature heat exchanger 605, and so on, are connected with one another through pipe arrangement. The upper body 601 is constituted by a condenser 611 and a low temperature regenerator 612. The lower body 602 is constituted by an evaporator 621 and an absorber 622. The high temperature regenerator 603 includes a burner 631.

In the absorption refrigerator, cooling water is circulated between the refrigerator and an outdoor cooling tower. Therefore, dust or the like in the outside air is absorbed in the cooling water in the course of circulation. When the cooling water absorbing dust and the like passes through a heat exchange unit such as the absorber or the condenser, the heating surface thereof is polluted so that the heat exchange rate deteriorates. When the cooling water system of the absorption refrigerator is polluted, the efficiency of the refrigerator is reduced in proportion to the degree of the pollution. Then, the advance of this symptom may cause a serious failure such as abnormality in the high temperature regenerator or crystallization of absorbent. When such a failure occurs, operation cannot be kept on.

Therefore, in the invention disclosed in Japanese Patent Laid-Open No. 151416/1995, temperatures in a plurality of portions which may be affected by the pollution of the heating surface of cooling water pipe arrangement passing through the absorber and the condenser are detected by sensors. Then, evaluation data expressing the lowering of the heat transfer performance is made up on the basis of the outputs of the sensors. Time averages are calculated from the evaluation data and compared with their reference values. Thus, pollution of the cooling water is judged.

However, it is the pollution of the cooling water that can be judged in this invention. That is, the lowering of the performance of the absorption refrigerator as a heat source unit or the occurrence of abnormality in the absorption refrigerator due to other factors cannot be evaluated.

SUMMARY OF THE INVENTION

The present invention was developed in consideration of such actual situation of the related art. It is an object of the invention to provide a management apparatus and a management method in which time to inspect a heat source unit for an air conditioner can be forecast accurately before the performance of the heat source unit is lowered or abnormality occurs in the heat source unit.

It is another object of the invention to provide a management apparatus and a management method in which maintenance is carried out on the basis of the aforementioned accurate forecast so that the loss of a user using the heat source unit can be suppressed, and further the cost required for operating the heat source unit can be reduced.

To attain the foregoing objects, a first aspect of the invention provides an apparatus for managing at least one heat source unit for an air conditioner, including: means for analyzing cyclic operation condition of the heat source unit from operating data of the heat source unit, the cyclic operation condition having an operating cycle of operation, dilution and stop; means for averaging the cyclic operation condition for a predetermined period; means for storing the averaged data into a storage unit in time series; means for comparing the data stored in time series with analyzed data of current cyclic operation condition obtained by the analyzing means; means for detecting a variation, with time, in lowering of performance and/or degree of advance of abnormality in the heat source unit on and after start of use of the heat source unit, based on a comparison result produced by the comparing means; means for estimating degree of deterioration of the heat source unit on and after the start of use based on the variation with time; and means for determining maintenance time from a predetermined deterioration threshold value and the estimated degree of deterioration.

A second aspect of the present invention provides an apparatus for managing at least one heat source unit for an air conditioner, including: means for estimating temperatures of respective portions of the heat source unit during operation based on one of a temperature history during start-up of the heat source unit and a temperature history during stop of the heat source unit; means for averaging temperature in cyclic operation condition of the heat source unit for a predetermined period, the cyclic operation condition having an operating cycle of operation, dilution and stop; means for storing the averaged temperature data into a storage unit in time series; means for comparing the temperature data stored in time series with the temperature data of the respective portions estimated by the estimating means; means for detecting a variation, with time, in lowering of performance and/or degree of advance of abnormality in the heat source unit on and after start of use of the heat source unit, based on a comparison result produced by the comparing means; means for estimating degree of deterioration of the heat source unit on and after the start of use based on the variation with time; and means for determining maintenance time from a predetermined deterioration threshold value and the estimated degree of deterioration.

A third aspect of the present invention provides an apparatus for managing at least one heat source unit for an air conditioner, including a central monitoring unit connected to the heat source unit for the air conditioner through an information communication network and for carrying out remote central control upon the heat source unit for the air conditioner. The central monitoring unit includes a control unit for managing the heat source unit for the air conditioner. The control unit includes: means for analyzing cyclic operation condition of the heat source unit from operating data of the heat source unit transmitted through the information communication network, the cyclic operation condition having an operating cycle of operation, dilution and stop; means for averaging the cyclic operation condition for a predetermined period; means for storing the averaged data into a storage unit in time series; means for comparing the data stored in time series with analyzed data of current cyclic operation condition obtained by the analyzing means; means for detecting a variation, with time, in lowering of performance and/or degree of advance of abnormality in the heat source unit on and after start of use of the heat source unit, based on a comparison result between the stored data and the analyzed data; means for estimating degree of deterioration of the heat source unit on and after the start of use based on the variation with time; and means for determining maintenance time from a predetermined deterioration threshold value and the estimated degree of deterioration.

A fourth aspect of the present invention provides an apparatus for managing at lest one heat source unit for an air conditioner, including a central monitoring unit connected to the heat source unit for the air conditioner through an information communication network and for carrying out remote central control upon the heat source unit for the air conditioner. The central monitoring unit includes a control unit for managing the heat source unit for the air conditioner. The control unit includes: means for estimating temperatures of respective portions of the heat source unit during operation based on one of a temperature history during start-up of the heat source unit and a temperature history during stop of the heat source unit, the temperature histories being transmitted through the information communication network; means for averaging temperature in cyclic operation condition of the heat source unit for a predetermined period, the cyclic operation condition having an operating cycle of operation, dilution and stop; means for storing the averaged temperature data into a storage unit in time series; means for comparing the temperature data stored in time series with the temperature data of the respective portions estimated by the estimating means; means for detecting a variation, with time, in lowering of performance and/or degree of advance of abnormality in the heat source unit on and after start of use of the heat source unit, based on a comparison result between the stored temperature data and the estimated temperature data; means for estimating degree of deterioration of the heat source unit on and after the start of use based on the variation with time; and means for determining maintenance time from a predetermined deterioration threshold value and the estimated degree of deterioration.

According to a fifth aspect of the present invention, in the first to fourth aspects, a temperature history during operation of the heat source unit is compared with a pattern of a temperature history during occurrence of abnormality stored in the storage unit in advance, so as to conduct diagnosis on abnormal condition of the heat source unit.

According to a sixth aspect of the present invention, in the first to fourth aspects, there is further provided means for changing control logic concerning start and stop of the heat source unit in accordance with the degree of deterioration estimated by the means for estimating the degree of deterioration on and after the start of use based on the variation with time.

According to a seventh aspect of the present invention, in the first to fourth aspects, there is further provided means for changing control logic concerning start and stop of the heat source unit in accordance with the degree of deterioration estimated by the means for estimating the degree of deterioration on and after the start of use based on the variation with time. The means for changing the control logic selects control logic for stopping the heat source unit when the heat source unit is diagnosed as abnormal.

According to an eighth aspect of the present invention, in the first to fourth aspects, there is further provided means for changing control logic concerning start and stop of the heat source unit in accordance with the degree of deterioration estimated by the means for estimating the degree of deterioration on and after the start of use based on the variation with time. When the heat source unit is diagnosed as abnormal, the means for changing the control logic selects control logic to prevent abnormality from occurring in other portions due to the diagnosed abnormality of the heat source unit.

According to a ninth aspect of the present invention, in the first to fourth aspects, there are further provided: means for calculating real heat load on the air conditioner connected to the heat source unit, based on analytic data analyzed by the analyzing means; means for storing, into a storage unit, time-series data of the heat load on the air conditioner connected to the heat source unit; means for comparing the stored time-series data with current data, and judging whether a difference between the stored time-series data and the current data is permanent or not; and means for correcting and updating a pattern of the heat load to thereby estimate future heat load when the judging means concludes that the difference is permanent.

According to a tenth aspect of the present invention, in the first to fourth aspects, a plurality of heat source units are provided as the at least one heat source unit.

According to an eleventh aspect of the present invention, in the tenth aspect, there is further provided means for operating a heat source unit having a smaller degree of deterioration by priority based on the future heat load estimated by the means for estimating the heat load.

A twelfth aspect of the present invention provides a method for managing at least one heat source unit for an air conditioner, including the steps of: analyzing cyclic operation condition of the heat source unit from at least one piece of operating data of the heat source unit, the cyclic operation condition having an operating cycle of operation, dilution and stop; averaging the cyclic operation condition for a predetermined period; storing the averaged data into a storage unit in time series; comparing the data stored in time series with analyzed data of current cyclic operation condition obtained by the analyzing step; detecting a variation, with time, in lowering of performance and/or degree of advance of abnormality in the heat source unit on and after start of use of the heat source unit, based on a comparison result between the stored data and the analyzed data; estimating degree of deterioration of the heat source unit on and after the start of use based on the variation with time; and determining maintenance time from a predetermined deterioration threshold value and the estimated degree of deterioration.

A thirteenth aspect of the present invention provides a method for managing at least one heat source unit for an air conditioner, in which a central monitoring unit is connected to the heat source unit for the air conditioner through an information communication network and carries out remote central control upon the heat source unit for the air conditioner. The method includes the steps of: analyzing cyclic operation condition of the heat source unit from operating data of the heat source unit transmitted through the information communication network, the cyclic operation condition having an operating cycle of operation, dilution and stop; averaging the cyclic operation condition for a predetermined period; storing the averaged data into a storage unit in time series; comparing the data stored in time series with analyzed data of current cyclic operation condition obtained by the analyzing step; detecting a variation, with time, in lowering of performance and/or degree of advance of abnormality in the heat source unit on and after start of use of the heat source unit, based on a comparison result between the stored data and the analyzed data; estimating degree of deterioration of the heat source unit on and after the start of use based on the variation with time; and determining maintenance time from a predetermined deterioration threshold value and the estimated degree of deterioration.

According to a fourteenth aspect of the present invention, in the twelfth aspect or the thirteenth aspect, the cyclic operation condition is a temperature condition.

According to a fifteenth aspect of the present invention, in the twelfth aspect or the thirteenth aspect, a plurality of heat source units are provided as the at least one heat source unit.

Incidentally, in the embodiments which will be described later, the means for analyzing the cyclic operation condition corresponds to means for executing Step 204 in FIG. 2; the means for averaging the cyclic operation condition corresponds to means for executing Step 206 in FIG. 2; the storage unit corresponds to an equipment condition database 24; the means for storing the averaged data into the storage unit corresponds to means for executing Step 207 in FIG. 2; the means for detecting a variation with the passage of time corresponds to means for executing Step 208 in FIG. 2; and the estimating means and the determining means correspond to means for executing Step 209 and Step 210 in FIG. 2 respectively. The means for executing these steps corresponds to an equipment condition diagnosis portion 13.

In addition, the means for diagnosing the abnormal state of the heat source unit corresponds to means for executing Step 309 to Step 311 in FIG. 4. The means for executing these steps corresponds to the equipment condition diagnosis portion 13. In addition, means for changing the control logic about start and stop of the heat source unit corresponds to a control logic generation portion 14; the means for calculating the real heat load, the judging means and the means for estimating the future heat load correspond to a heat load calculation portion 61 respectively. The means for operating a heat source unit having a smaller degree of deterioration by priority corresponds to the control logic generation portion 14.

Further, the steps executed in the method correspond to the steps executed by the aforementioned respective means.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE INVENTION

Embodiments of the present invention will be described below with reference to the drawings.

FIGS. 1 to 5 explains a first embodiment of the present invention. Incidentally, description will be made on the case where absorption heaters/chillers are used as heat source units for an air conditioner in this embodiment. However, the kind of heat source unit is not limited to the absorption heater/chiller.

Figure 6:
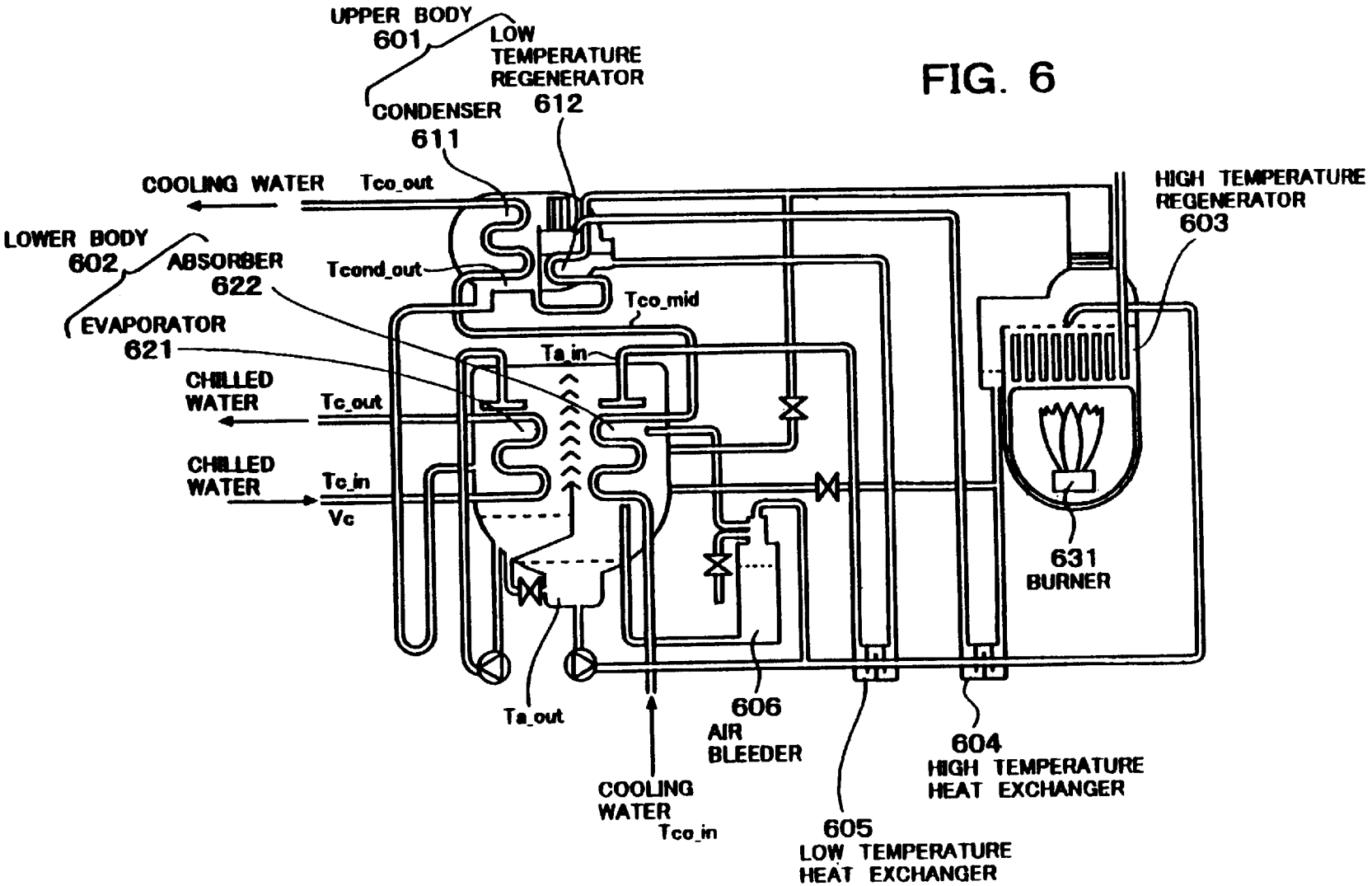
FIG. 6 is a diagram showing an example of a heat source unit for an air conditioner implemented in the related-art.

First, the configuration and operating cycle of a double-effect absorption refrigerator which is one of applications of the present invention will be described below. Incidentally, constituent members the same as those in FIG. 6 are referred to as the same numerals correspondingly.

This double-effect absorption refrigerator uses water as refrigerant and lithium bromide (LiBr) as absorbent. The double-effect absorption refrigerator has a high temperature regenerator 603, a low temperature regenerator 612, a condenser 611, an evaporator 621, an absorber 622, a solution pump, a refrigerant spray pump, a low temperature heat exchanger 605, a high temperature heat exchanger 604 and an air bleeder 606. The high temperature regenerator 603 has a heating source such as a burner 631 or the like, by which an aqueous solution having the refrigerant and the absorbent mixed with each other is heated to generate refrigerant steam. In the low temperature regenerator 612, the aqueous solution is heated by use of the refrigerant steam generated in the high temperature regenerator 603 as a heating source, so as to generate refrigerant steam. In the condenser 611, the refrigerant steam generated in the low temperature regenerator 612 and the refrigerant generated from the high temperature regenerator 603 and liquefied by heating the aqueous solution in the low temperature regenerator 612 are cooled and condensed by cooling water flowing in a pipe. In the evaporator 621, the liquid refrigerant condensed in the condenser 611 is sprayed and evaporated from a spray header so as to absorb latent heat of vaporization from brine (refrigerated water) flowing in the pipe and thereby cool the brine. In the absorber 622, the aqueous solution high in concentration (concentrated solution) introduced from the high temperature regenerator 603 and the lower temperature regenerator 612 is sprayed from a spray header, while being cooled by the cooling water flowing in the pipe so that the refrigerant steam evaporated in the evaporator 621 is absorbed in the solution. Thus, a dilute solution is produced. The dilute solution produced in the absorber 622 is fed to the high temperature regenerator 603 (and the low temperature regenerator 612) by the solution pump. The air bleeder 606 collects the air (noncondensable gas) existing in a body receiving the absorber 622 (the air is leaked into the body because the pressure in the body is lower than the atmospheric pressure), and discharges the collected air to the outside of the body.

When operation is started, the dilute solution in the absorber 622 is supplied to the high temperature regenerator 603 (and the low temperature regenerator 612) through the low temperature heat exchanger 605 and the high temperature heat exchanger 604 by the solution pump. The dilute solution is heated by the burner in the high temperature regenerator 603 so as to generate refrigerant steam. On the other hand, the concentration of the solution in the high temperature regenerator 603 is increased. The refrigerant steam is introduced into the heating pipe of the low temperature regenerator 612. The refrigerant steam heats the solution in the low temperature regenerator 612 so as to generate refrigerant steam and be liquefied itself. The liquefied refrigerant is introduced into the condenser 611. The refrigerant steam generated in the low temperature regenerator 612 is introduced into the condenser 611 so as to be cooled and liquefied by the cooling water flowing in the pipe. The liquefied refrigerant is introduced into the evaporator 621. The refrigerant introduced into the evaporator 621 is sprayed from the spray header by the refrigerant pump so as to be evaporated. The refrigerant absorbs latent heat of vaporization for its evaporation from the brine flowing in the pipe and thereby cool the brine to a temperature suitable for air conditioning. The refrigerant steam evaporated in the evaporator 621 flows into the absorber 621 through an eliminator. The refrigerant steam is brought into contact with the concentrated solution introduced from the low temperature regenerator 612 (and the high temperature regenerator 603) into the absorber 622 through the heat exchangers and sprayed from the spray header. Thus, the refrigerant steam is absorbed into the concentrated solution so that a dilute solution with more refrigerant being mixed therein is produced. The cooling water flows in the absorber 622 and the condenser 611 in this order. The pressure in the absorber 622 is kept lower than the pressure in the evaporator 621.

When the heating with the burner 631 is stopped to stop the operation of the refrigerator, the solution pump and the refrigerant pump are kept operating for a while, so as to circulate the solution through the high temperature regenerator 603, the low temperature regenerator 612 and the absorber 622. Thus, difference in the concentration of the solution among the high temperature regenerator 603, the low temperature regenerator 612 and the absorber 622 is made small. At the same time, the refrigerant steam of the evaporator 621 is absorbed in the solution in the absorber 622 so that the concentration of the solution is made as thin as possible. After such a dilution operation for preventing the solution from being crystallized in the high temperature regenerator 603 and the low temperature regenerator 612, the operation of the refrigerator is stopped. In such a manner, the double-effect absorption refrigerator is operated in a cycle of operation start, dilution operation and operation stop.

FIGS. 1(A), (B) are system diagrams concerning remote central control of air conditioner heat source units. The management system for the air conditioner heat source units is constituted by a service company 1 and a customer 100, which are connected through an information communication network 90. Heat source units 101 owned by the customer 100 are managed by the service company 1. The service company 1 is fundamentally constituted by a central monitoring unit 10, a maintainer 30, a business office 40, a service aid section 50, an equipment refurbishment proposal section 60, an account section 70 and a materials section 80.

The central monitoring unit 10 is constituted by processing portions such as a data reception portion 11, a data conversion portion 12, an equipment condition diagnosis portion 13, a control logic generation portion 14 and a data/signal transmitting portion 15, databases such as a customer operation database 21, a customer equipment database 22, a failure case database 23 and an equipment condition database 24, an output unit 27 and an input unit 26.

The maintainer 30 carries a portable terminal 31 so as to send and receive necessary information. The business office 40 includes an output unit 27, a process control system 42 and a maintenance plan estimating/making system 41. The service aid section 50 has the failure case database 23 and an equipment condition detailed diagnosis tool 51. In addition, the equipment refurbishment proposal section 60 is provided with a heat load calculation portion 61, an accessory setting portion 62, a deterioration/life diagnosis portion 63, a heat source unit setting portion 64, and an equipment refurbishment proposal portion 65 which receives the outputs of these members 61 to 64. Further, the account section 70 is provided with a slip creating system 71, and the materials section 80 is provided with an inventory management system 81.

On the other hand, the customer 100 is provided with a plurality of heat source units 101, a plurality of monitoring terminals 104 provided for the heat source units 101 respectively, a unit number control panel 103, a relay 105 and an output unit 107. In addition, each of the heat source units 101 is provided with an operating panel 102 and sensors 106. The outputs of the sensors 106 are supplied to the monitoring terminal 104 corresponding to the heat source unit 101, and the operating output from the monitoring terminal 104 is supplied to the operating panel 102. The relay 105 is connected to the information communication network 90 so as to relay information between the central monitoring unit 10 and each of the output unit 107, the monitoring terminals 104 and the unit number control panel 103.

Generally, one or a plurality of air conditioner heat source units 101 are installed in every residential or industrial building. The service company 1 installs the monitoring terminals 104 for the heat source units 101 respectively, and connects the monitoring terminals 104 with the central monitoring unit 10 through the information communication network 90 so as to perform remote central control. Thus, a management system is built up.

Each monitoring terminal 104 has a signal input portion, an information storage portion, an arithmetic control portion, a transmitting portion, and a transmitting/receiving portion. The signal input portion receives signals from the sensors 106 for measuring state quantities of respective portions in order to grasp the operating condition of the heat source unit 101, and other signals concerning the operating condition of the heat source unit 101. The information storage portion stores the input signals and information such as signal input time. The arithmetic control portion judges abnormality based on the input signals. The transmitting portion transmits the stored information to the central monitoring unit 10. The transmitting/receiving portion receives an operating signal concerning the heat source unit 101 from the central monitoring unit 10, and transmits the operating signal to the operating panel 102 attached to the heat source unit 101. For example, in the case of an absorption chiller/heater, the signals for grasping the condition of the heat source unit 101 include signals indicating physical quantities of respective portions of the chiller/heater such as a high temperature regenerator solution temperature, a low temperature regenerator refrigerant condensing temperature, a chilled/heated water inlet temperature, a chilled/heated water outlet temperature, a cooling water inlet temperature, a cooling water outlet temperature, an exhaust gas temperature of a burner installed in the high temperature regenerator, a high temperature regenerator pressure, a condenser pressure and an evaporator pressure, signals indicating operating states of a solution circulating pump, a refrigerant circulating pump and the high temperature regenerator burner, and further control signals issued from the operating panel 102 attached to the absorption chiller/heater body.

When a plurality of heat source units (chillers/heaters) 101 are installed in an air conditioner, the unit number control panel 103 is generally installed to control start and stop of the plurality of heat source units 101. Information is also transmitted and received between the unit number control panel 103 and the central monitoring unit 10. In FIG. 1(A), the respective monitoring terminals 104 and the unit number control panel 103 are connected to the central monitoring unit 10 through the relay 105 installed in the building in which the plurality of heat source units 101 are installed. Incidentally, although the aforementioned configuration is made thus in this embodiment, the invention is not limited to the illustrated embodiment if the respective heat source units 101 and the unit number control panel 103 can transmit and receive information to and from the central monitoring unit 10.

Information transmitted from the monitoring terminals 104 in a predetermined format is received in the data reception portion 11 of the central monitoring unit 10 and accumulated in the customer operation database 21. Incidentally, the information transmitted from the monitoring terminals 104 to the central monitoring unit 10 may be compressed to reduce the load on the information communication network 90 or encrypted to prevent the information from leaking out to third parties other than the customer 100 and the service company 1. It is therefore preferable that the data conversion portion 12 is provided in the central monitoring unit 10 so as to convert the information into a format which can be used for equipment condition diagnosis or other operation data analyses. The received information is accumulated in the customer operation database 21 while diagnosis is carried out on the received information in the equipment condition diagnosis portion 13.

The analytic processing in the equipment condition diagnosis portion 13 depends on the operating condition of each heat source unit. However, as for a heat source unit whose operating time is long so that the heat source unit is often in a stable state, diagnosis can be carried out thereon by solving the thermal and physical balance in the respective portions of the operating cycle of the heat source unit by use of temperatures or pressures in the respective portions of the heat source unit as boundary conditions. In this case, diagnosis is performed by calculation using previously expected problems, such as pollution of tubes or solution concentration in the refrigerant, as parameters, so as to make errors between measured temperatures of respective portions and their analyzed results as small as possible.

Incidentally, in the case of a machine in which the load on the heat source unit is small, and start and stop are frequently repeated, there may be adopted a method in which calculation is made using measured data of temperatures or pressures in an unsteady state as boundary conditions on the basis of thermal or physical balance in the same manner as in the case where there is data in a stable state. However, it can be considered to adopt a method in which diagnosis is made using a stable state estimated from a history of temperatures or pressures in an unsteady state. Description will be made below on this diagnostic method.

Figure 1:
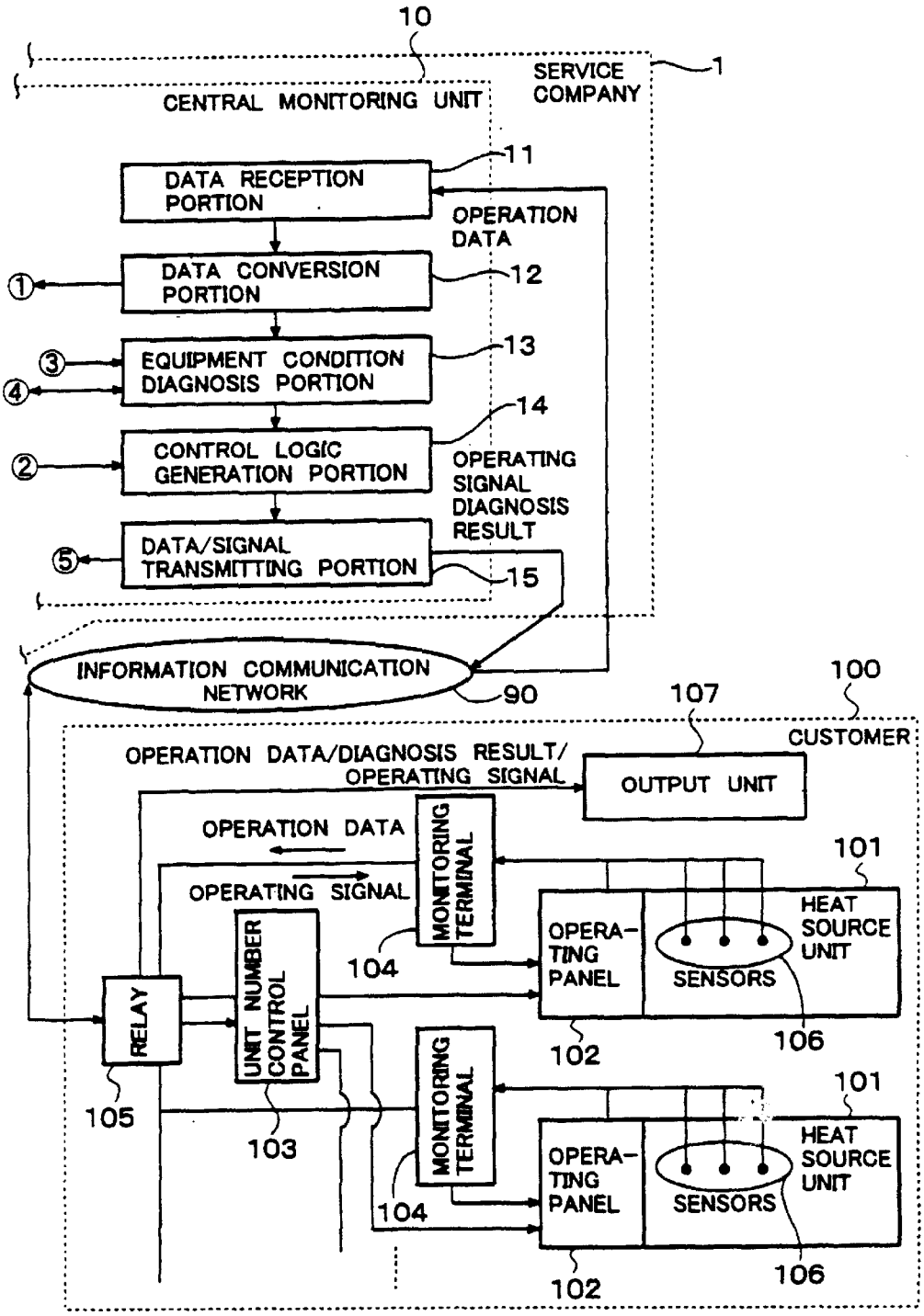
FIGS. 1(A), (B) are system diagrams about remote central control of heat source units for an air conditioner according to the present invention.
Figure 1B:
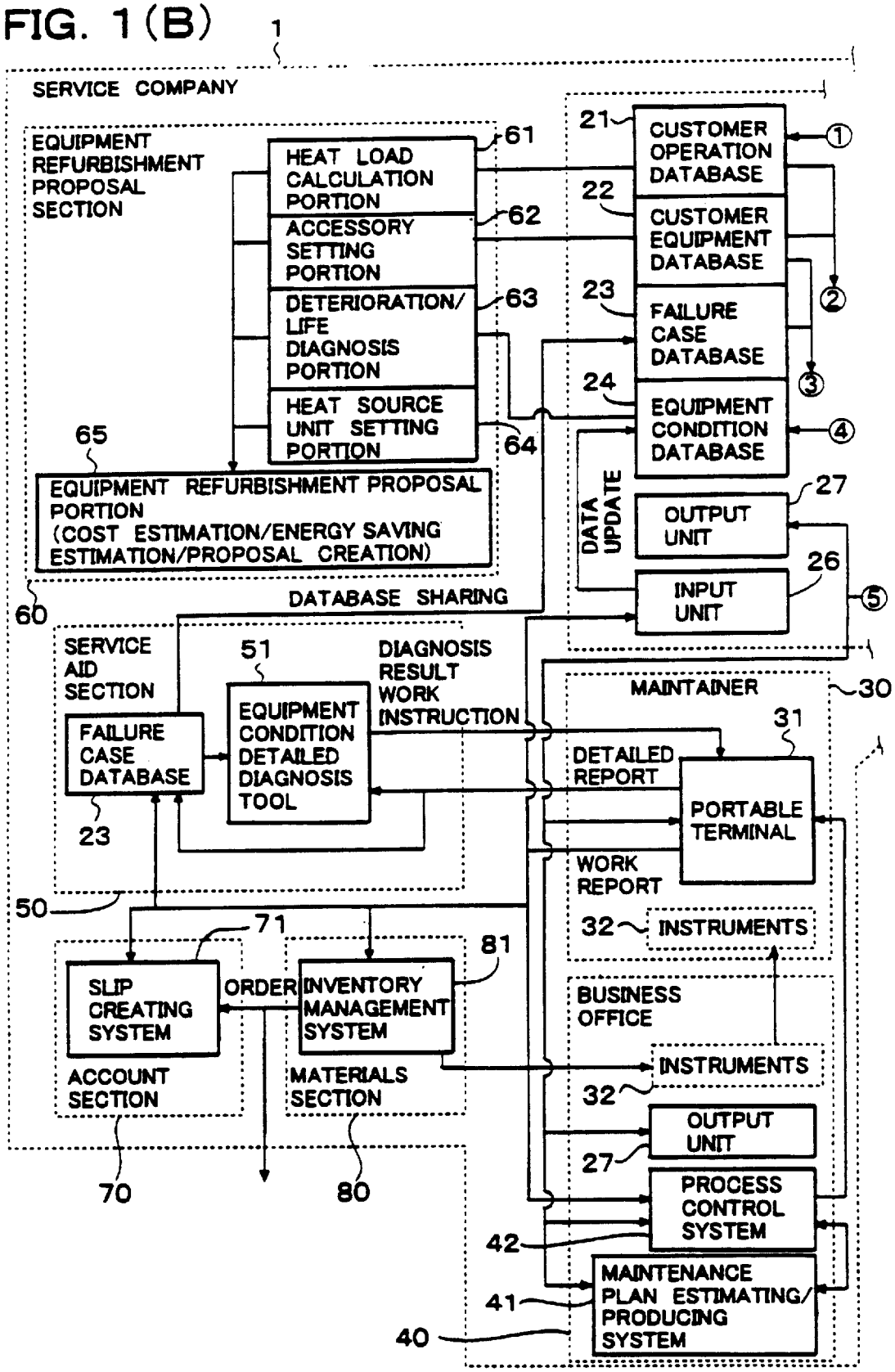
Figure 2:
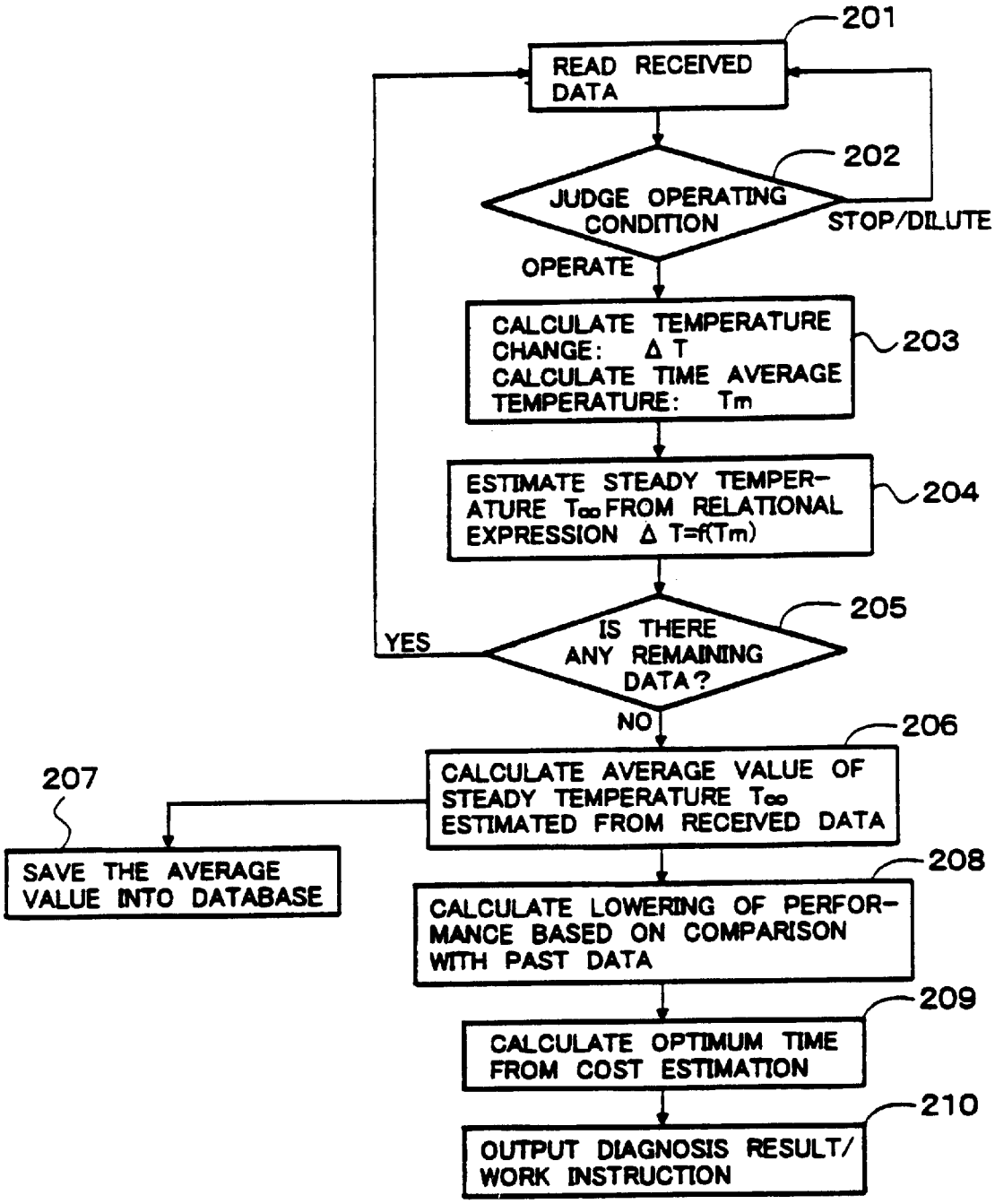
FIG. 2 is a flow chart for diagnosing the lowering of performance of the heat source unit according to the present invention.
Figure 3A:
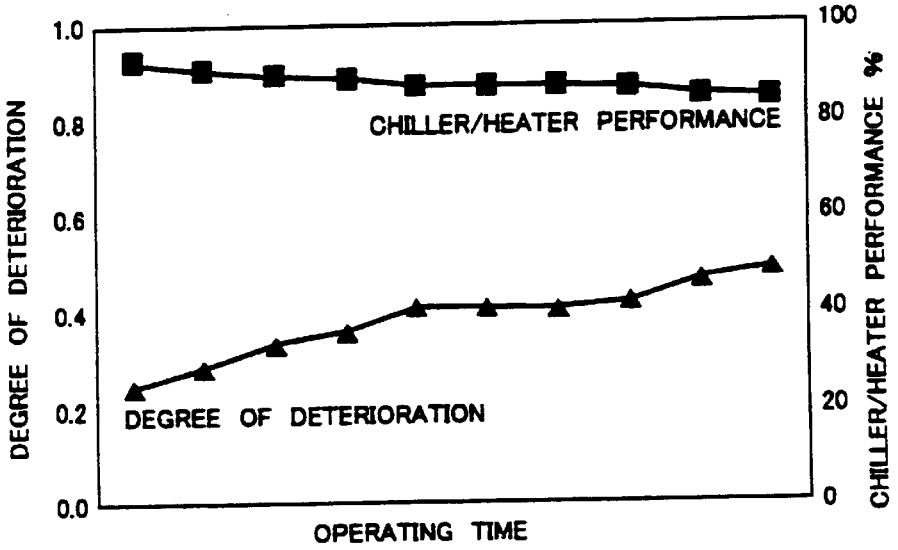
FIGS. 3(A) to (D) are graphs showing a diagnosis result about the lowering of performance of the heat source unit according to the present invention.
Figure 3B:
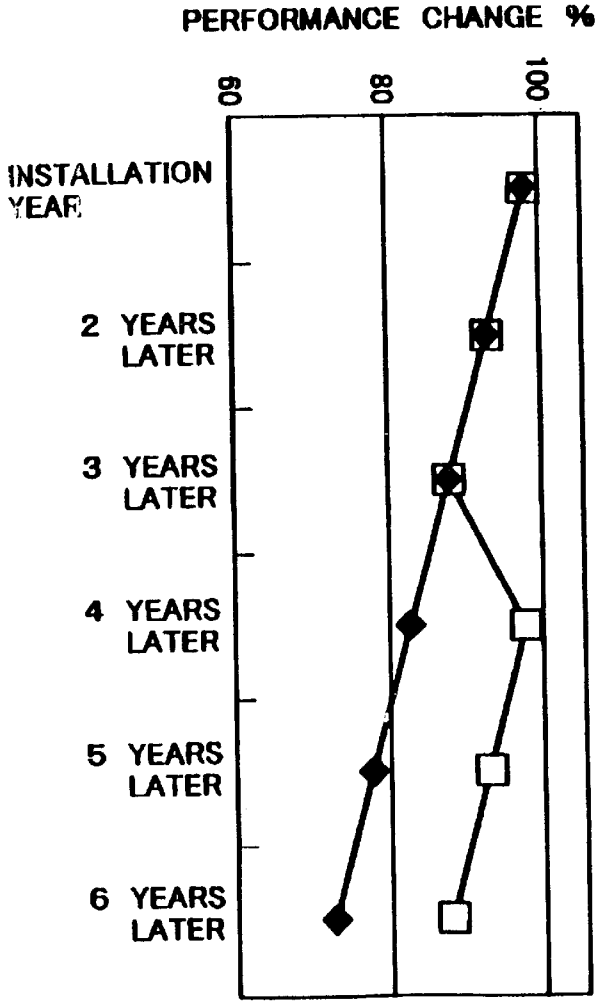
Figure 3C:
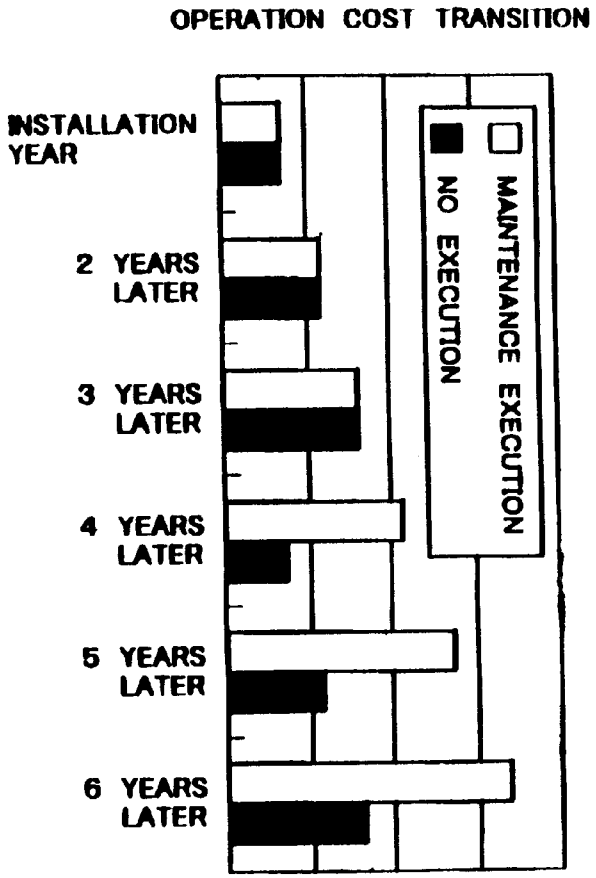
Figure 3D:
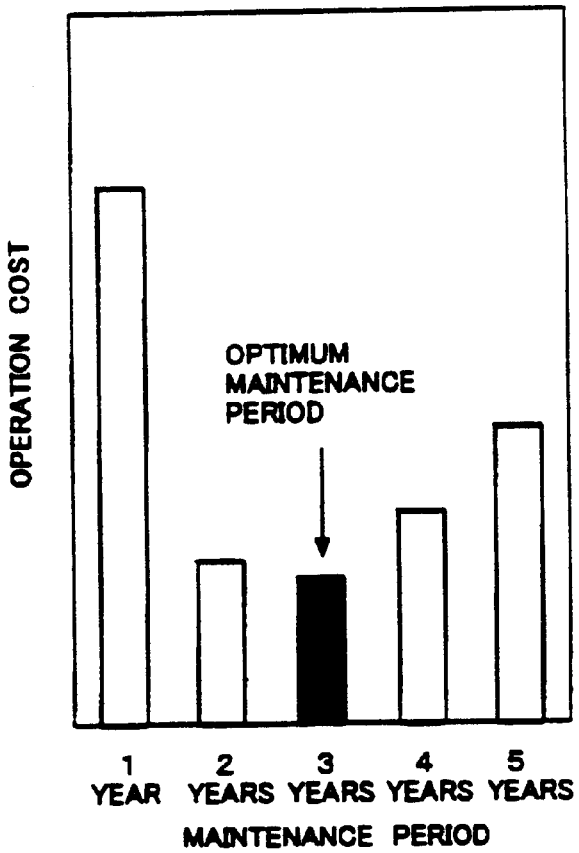
Figure 4:
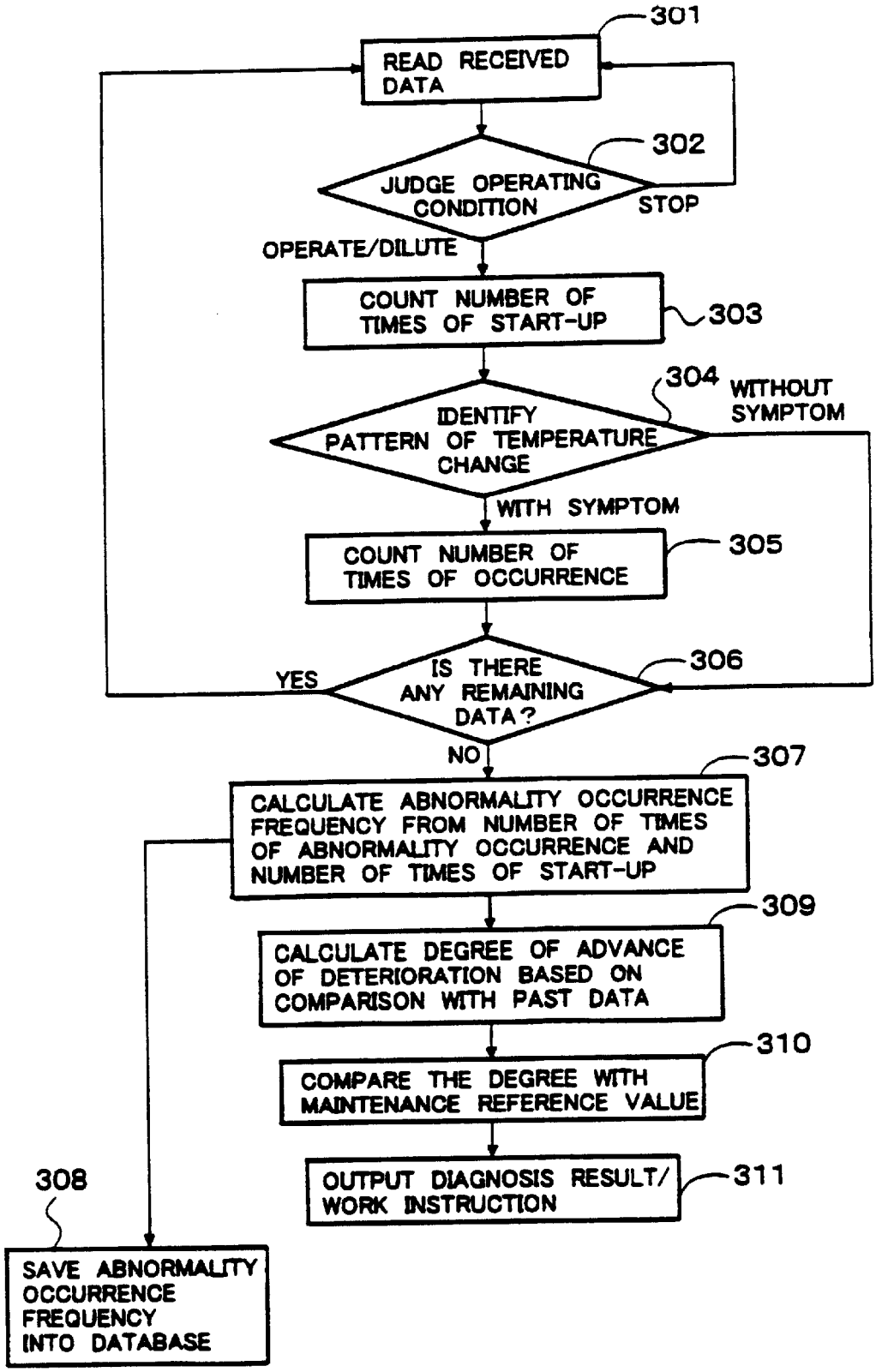
FIG. 4 is a flow chart for diagnosing the abnormality of the heat source unit according to the present invention.

In the equipment condition diagnosis portion 13, processing is carried out in the procedure shown in the flow chart of FIG. 2 or 4. FIG. 2 is a flow chart showing the diagnostic procedure in which the relationship between the temperature change rate and the time average temperature is obtained from a temperature history at the time of start-up of the heat source unit 101, the condition where the temperature is substantially stable in each portion of the heat source unit 101 is estimated by an expression showing the relation between the temperature change rate and the time average temperature, and the advance of performance lowering is diagnosed from the difference between the estimated stable condition and the past estimated stable condition.

First, in Step 201, temperature data T(n) of the heat source unit 101 in which pieces of data T(n−1), T(n), T(n+1) . . . received by the central monitoring unit 10 have been arranged in time series and time instants when the data were acquired are read in. Next, in Step 202, the operating condition of the heat source unit 101 is classified into three states of "OPERATE", "DILUTE" and "STOP" on the basis of the difference between the target temperature data T(n) and the previous temperature data T(n−1). Here, when it is concluded that the target temperature data is data during "DILUTE" or "STOP", the routine of processing returns to Step 201, reading the next data T(n+1).

When it is concluded in Step 202 that the target temperature data is data during "OPERATE", the routine of processing advances to Step 203. In Step 203, a temperature change rate ΔT(n) defined by the following expression (1) using an acquisition interval τ(n) between the target temperature data T(n) and the previous temperature data T(n−1), and a time average temperature Tm(n) defined by the following expression (2) are obtained.

$$\Delta T(n)=\{T(n)-T(n-1)\}/\tau(n) \tag{1}$$

$$Tm(n)=\{T(n)+T(n-1)\}/2 \tag{2}$$

Next, in Step 204, on the basis of the relationship between the temperature change rate ΔT and the time average temperature Tm(n), a temperature T∞(n) in the stable state where the temperature change rate ΔT=0 is obtained from the values ΔT(n) and Tm(n) calculated in Step 203, as shown in the following expression (3).

$$T\infty(n)=1/[1/Tm(n)-\{Ln(1+\Delta T(n))/A\} \tag{3}$$

Incidentally, A in the expression (3) designates a coefficient. The coefficient A can take a different value from one heat source unit 101 to another. Therefore, the coefficient A is stored as database in the central monitoring unit in advance on the basis of inspection data at the time of shipment of the heat source unit 101 or operating data at the time of installation of the heat source unit 101. Next, in Step 205, it is judged whether calculation is terminated on all the pieces of received data or not. When there is a remaining piece of data, the routine of processing returns to Step 201. When calculation is terminated on all the pieces of data, the routine of processing advances to Step 206.

In Step 206, an average value of the stable-state temperature T∞(n) which can be obtained from the received data is obtained. The average value is regarded as a stable state in the stage where the data was received. The average value of the stable-state temperature T∞(n) is stored in the equipment condition database 24 in Step 207 for use in the subsequent diagnosis. In this processing, averaging is carried out.

Next, in Step 208, the past stable state stored as database is read and compared with the stable state obtained in Step 206, and on the basis of the comparison, the lowering of performance and the degree of advance of the performance lowering are calculated from the performance lowering and the change of the stable state stored as database in advance. Incidentally, on the basis of the stable state obtained by the aforementioned means, diagnosis of the heat source unit may be carried out by use of the aforementioned means for analyzing the stable state.

Next, in Step 209, the future fuel cost based on the operation of the heat source unit 101 is estimated from the degree of advance of the performance lowering estimated in Step 208 and the past operating time. Further, the future fuel cost required if maintenance is performed is estimated likewise. Thus, the maintenance time in which the operating cost of the heat source unit 101 obtained by summing the maintenance cost and the fuel cost becomes minimal is obtained. Then, a diagnosis result is output in the form shown in FIGS. 3(A) to (D), including the current degree of performance lowering, the degree of advance of performance lowering, the maintenance time, and the effect of reduction in fuel cost attributing to the maintenance. In this diagnostic method, how accurately the stable state of the heat source unit 101 is estimated is an important factor for the accuracy of the diagnosis. Therefore, a period such as one week or one month is set in advance, and averaging is carried out on an estimated stable state for the set period so that the advance of performance lowering can be grasped more accurately.

FIG. 4 is a flow chart showing the procedure of diagnosis for evaluating the degree of abnormality in equipment constituting the heat source unit 101 as follows. That is, the temperature history during the operation of the absorption heat source unit is compared with its temperature history during the occurrence of abnormality so as to identify a similar pattern of temperature history during the occurrence of abnormality. Then, a phenomenon regarded as abnormal is evaluated from the number of times of occurrence, the integrated value of the number of times of occurrence or the frequency of occurrence obtained by dividing the number of times of occurrence by the number of times of start-up.

First, in Step 301, temperature data T(n) of the heat source unit 101 in which pieces of data T(n−1), T(n), T(n+1) . . . received by the central monitoring unit 10 have been arranged in time series and time instants when the data were acquired are read in the same manner as in the aforementioned diagnostic method. Next, in Step 302, the operating condition of the heat source unit 101 is classified into three states of "OPERATE", "DILUTE" and "STOP" on the basis of the difference between the target temperature data T(n) and the previous temperature data T(n−1). Here, when it is concluded that the target temperature data is data during "STOP", the routine of processing returns to Step 301, reading the next data T(n+1).

When it is concluded in Step 302 that the target temperature data is data during "OPERATE" or "DILUTE", the routine of processing advances to Step 303, in which when the previous data is judged as "DILUTE" or "STOP" and the target data is judged as "OPERATE", the counter for the number of times of start-up is set forward. Further, the routine of processing advances to Step 304, in which a pattern of temperature change in the target temperature data is compared with a pattern of temperature change during abnormality stored in advance. When the two patterns are identical to each other, the counter for the occurrence of abnormality is set forward in Step 305 so as to count the number of times of occurrence of abnormality. Then, the routine of processing advances to Step 306. When it is concluded in Step 304 that the pattern of temperature change in the target temperature data is different from the pattern of temperature change during abnormality (that is, the pattern can be regarded as normal), the routine of processing advances to Step 306. In Step 306, it is judged whether judgement is terminated on all the pieces of received data or not. When there is a remaining piece of data, the routine of processing returns to Step 301. When judgement is terminated on all the pieces of data, the routine of processing advances to Step 307.

Figure 5:
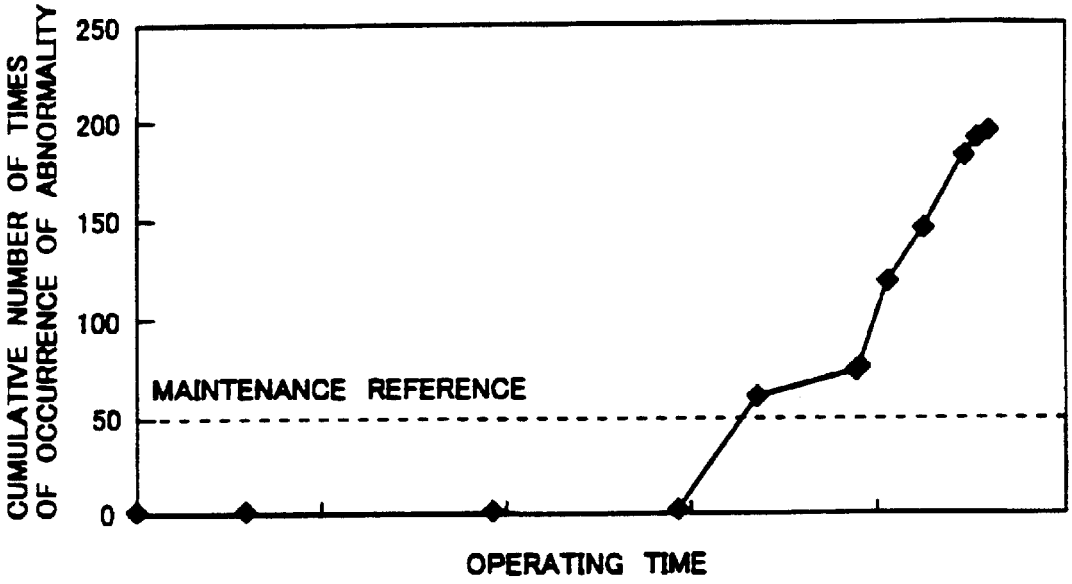
FIG. 5 is a graph showing a diagnosis result about the abnormality of the heat source unit according to the present invention.

In Step 307, the number of times of occurrence of abnormality per number of times of start-up, that is, the frequency of occurrence of abnormality is calculated from the number of times of start-up counted in Step 303 and the number of times of occurrence of abnormality counted in Step 305. Then, in Step 308, the number of times of occurrence of abnormality, the number of times of start-up and the frequency of occurrence of abnormality are saved in the equipment condition database 24 so as to be able to be used in the subsequent diagnosis. Next, in Step 309, the degree of advance of deterioration is obtained from the comparison with the past number of times of occurrence of abnormality or the past frequency of occurrence of abnormality or from the integrated value of the number of times of occurrence of abnormality. In Step 310, the degree of advance of deterioration is compared with a maintenance reference value. In Step 311, a diagnosis result is output, including the degree of advance of deterioration and the number of times of occurrence of abnormality. An actual diagnosis result is displayed in the form shown in FIG. 5. The diagnosis result in FIG. 5 shows the integrated number of times of occurrence of a temperature change pattern identical to that during the occurrence of abnormality. However, it can be considered to adopt a method in which the degree of abnormality is shown not only by the integrated number of times but also by the frequency of occurrence of phenomena regarded as abnormal with respect to the number of times of start-up.

The diagnosis result using the diagnostic procedure shown in FIG. 2 or 4 is transmitted in the format shown in FIGS. 3(A) to (D) or 5, from the data/signal transmitting portion 15 of the central monitoring unit 10 to the output unit 27 of the central monitoring unit 10, or to the output unit 27, the maintenance plan estimating/making system 41 and the process control system 42 in the business office 40 which is a base of the maintainer 30. At the same time, the diagnosis result is transmitted to the output unit 107 of the customer 100, and displayed or printed out. The transmission of the diagnosis result makes it possible for the business office 40 to plan and estimate a maintenance program, make process control over the maintainer 30 and offer a prior proposal to the customer 100. Further, it is also made possible for the customer 100 to grasp the conditions of the heat source units 101 owned by the customer 100.

According to these diagnostic methods, it is possible to diagnose the condition of the equipment even when there is a comparatively large variation in the temperature or other physical quantities in each portion of the heat source units 101 immediately after the start-up and up to the stable state. Most of absorption chillers/heaters used as heat source units for air conditioners are controlled in their capabilities by combustion and suspension of their combustors for heating solutions in high temperature regenerators, and rarely operated in a stable state. According to these diagnostic methods, there is an advantage that diagnosis can be performed even on such chillers/heaters.

Next, in the control logic generation portion 14, an operation control method for suppressing the operating cost of the heat source units 101 or for reducing the probability of causing failure stop is made up on the basis of the performance lowering and the degree of advance of abnormality of the heat source units 101 grasped by the aforementioned diagnostic procedure. For example, when a plurality of absorption chillers/heaters are used as the heat source units 101 of the air conditioner of one and the same system as shown in FIG. 1(A), the number of operating units is changed in accordance with the load on the air conditioner. When a chiller/heater smaller in performance lowering is operated by priority, the cost required for operating the chillers/heaters can be reduced. In addition, by adopting a control logic in which the operating priority of a heat source unit 101 showing symptoms of abnormality is lowered, the probability that the heat source unit 101 in question is operated can be suppressed. By such a change of the control method, idle time of the heat source unit 101 in question can be secured so that the heat source unit 101 can be repaired before failure stop.

Further, as a countermeasure to prevent an absorption chiller/heater from causing failure stop or fatal damage when the absorption chiller/heater is judged as abnormal, there is a method in which a logic for changing the operating condition of the heat source unit (chiller/heater) 101 is made up in the control logic generation portion 14 of the central monitoring unit 10, and an operating signal based on the logic is transmitted by the transmitting portion 15 so as to change the operating condition of the chiller/heater. For example, when absorbent is mixed into refrigerant in the absorption chiller/heater, the evaporating temperature of the refrigerant increases so that the chiller/heater cannot show sufficient capability. On this occasion, it is necessary to feed the refrigerant from the evaporator to the regenerator so as to separate the refrigerant and the absorbent from each other again. When an electromagnetic valve is attached to the pipe arrangement for feeding the refrigerant from the evaporator to the regenerator, the operating condition can be changed by transmitting a signal to open the electromagnetic valve appropriately. In addition, in the absorption chiller/heater, cooling water is circulated through the chiller/heater in order to discharge the heat of absorption generated in the absorber or the heat of condensation of the refrigerant. When dirt is attached to the inside of the cooling water pipe, the chiller/heater may stop because of occurrence of high pressure in the chiller/heater. Further, also when there occurs high pressure in the chiller/heater for other reasons, the probability that the chiller/heater will stop may be easily anticipated on the basis of information from the monitoring terminal 104. In such a case, in a machine in which a burner provided in a high temperature regenerator can adjust its burning rate, the machine stop caused by the increase of in-machine pressure can be avoided by suppressing the burning rate. These are methods for changing the operating condition to avoid failure stop or to solve the abnormal state. When the chiller/heater has to be stopped and maintained at once in accordance with the degree of the failure, a stop signal is transmitted from the central monitoring unit 10 so that the chiller/heater in question can be prevented from being damaged fatally.

When such failure diagnosis and such determination of an operation control logic of chillers/heaters based on the failure diagnosis are carried out, it is known well that there appears a difference in operating condition due to a difference caused by equipment accompanying the chillers/heaters or due to an individual difference generated among the chillers/heaters in the stage of manufacturing the chillers/heaters though the chillers/heaters are operated normally. Not to say, such a difference causes a problem in failure diagnosis. To solve the problem, and further to provide more accurate failure diagnosis and more accurate operation control of chillers/heaters, the following method can be considered. That is, a customer equipment database 22 constituted by information about equipment accompanying the chillers/heaters or information such as performance curves of the chillers/heaters created on the basis of log sheets of the chillers/heaters in the stage of factory shipment is made up in advance. Then, the customer equipment database 22 is referred to when the failure diagnosis is performed or the control logic is determined. Further, it can be said that effective means in making the failure diagnosis more accurate is to make up a failure case database 23 which is used for verification carried out based on comparison of the diagnosis result with a real phenomenon so as to review the diagnostic method.

The diagnosis result of each chiller/heater and the control logic and operating signal made up thus are transmitted from the transmitting portion 15 to the corresponding monitoring terminal 104 and the unit number control panel 103 through the information communication network 90 and the relay 105 so as to change the control logic or change the operating condition in accordance with necessity. At the same time, the diagnosis result of each chiller/heater and the control logic and operating signal are transmitted to the output unit 107 belonging to the customer 100 so as to display operating data or the diagnosis result.

When abnormality needing the maintainer 30 to perform maintenance is detected in a heat source unit (chiller/heater) 101 by the equipment condition diagnosis portion 13, the maintainer 30 who is closest to the heat source unit 101 in question or who can rush to the heat source unit 101 in the shortest time is informed, through the portable terminal 31, of the contents of the failure, the contents of work for recovering from the failure and the information about necessary instruments, from the transmitting portion 15 of the central monitoring unit 10. In such a manner, it is possible to deal with the abnormality quickly. On this occasion, when the same information is transmitted to the business office 40 of the service company 1 which is a base of the maintainer 30, the business office 40 can aid the maintainer 30 with preparation of necessary instruments 32. In addition, the maintainer 30 may carry the portable terminal 31 so as to transmit a work report from the portable terminal 31 to the business office 40, the materials section 80 managing the inventory of parts and instruments, and further the account section 70. In this case, the work report can be used in the process control system 42, the inventory management system 81 and the slip creating system 71 so that maintenance service can be provided at lower cost and more quickly. For example, inventory control to grasp the inventory of parts or instruments in the business office 40, supplement parts estimated to be insufficient, or order the parts to parts makers can be performed on the basis of the transmitted work report. Thus, the maintenance work can be prevented from being delayed due to the shortage of parts or instruments. At the same time, when the work report is transmitted to the business office 40 or the account section 70, slips about billings of maintenance cost generated due to the work can be created automatically, or the process control of maintainers can be made in the business office 40. Thus, quick maintenance service can be provided. In addition, the work report can be made use of to confirm or update the diagnosis method for judging abnormality. Thus, higher accuracy in the abnormality diagnosis method can be attained. Further, when a maintainer carrying out maintenance on a chiller/heater has difficulty in identifying the place where the abnormality has occurred, the maintainer can transmit a detailed report about the chiller/heater in question to the service aid section 50. Thus, there can be established a mode of service aid by which on the basis of the comparison with past failure cases, a diagnosis result having more details than the diagnosis result transmitted from the central monitoring unit 10, or work instructions can be given to the maintainer. When such service aid is carried out, it is necessary to create and update the failure case database 23. To this end, the work report transmitted from the portable terminal 31 is utilized.

Further, when it is necessary to perform maintenance against age-based deterioration of a chiller/heater, maintenance service may be carried out together with periodic work of switching the chiller/heater between cooling operation and heating operation. In this case, maintenance can be performed at lower cost. Such service can be also realized by transmitting a diagnosis result obtained in the central monitoring unit 10 from the central monitoring unit 10 to the business office 40, and utilizing the diagnosis result for the process control of the maintainers 30 in the business office 40 so as to assign work to the maintainers 30 properly. In addition, when the advance of age-based deterioration is grasped, prior contact for maintenance time and an estimate of maintenance cost can be presented to the customer 100. Thus, there is also an advantage that the customer 100 can know the cost for equipment refurbishment in advance so as to form a budget easily.

Further, life diagnosis 63 is carried out on a machine in which age-based deterioration has in progress. In addition, loads on the respective heat source units 101 and the air conditioner to which the heat source units 101 have been connected, or annual operating conditions thereof are obtained in the heat load calculation portion 61 by use of the customer operation database 21. Thus, on the basis of the customer equipment information 22, setting about the air conditioner heat source units or accessories are done in the respective setting portions 62 and 64. Then, operating cost or environmental load evaluation is performed for equipment replacement. The evaluated cost for equipment replacement is compared with the cost for maintenance of the existing absorption chiller/heater and its operating cost. Thus, a proposal for equipment refurbishment can be made.

Incidentally, description in this embodiment has been made on the mode in which the monitoring terminal 104 is installed in each of the heat source units 101, and remote central control is carried out. However, similar service can be provided if the operating panel 102 attached to each of the heat source units 101 has a function as the monitoring terminal 104.

Next, description will be made on a second embodiment of the present invention with reference to FIGS. 1(A), (B). The system diagrams of FIGS. 1(A), (B) show the case where a plurality of heat source units 101 are used as heat source units for one and the same air conditioner. At this time, when inlet and outlet temperatures of cooling or heating water in the heat source units 101 are measured respectively, the states of loads on the respective heat source units 101 can be grasped in the central monitoring unit 10. Further, the transition of a heat load on the air conditioner can be forecast from the changes of the inlet and outlet temperatures of the cooling or heating water in the heat source units. Control logic such as selection of operating units which are the lowest in power consumption or gas consumption, determination of the number of operating units, establishment of operating priorities of the respective heat source units 101 or establishment of the load ratios of the respective heat source units 101 is determined for the forecast heat load on the air conditioner by the control logic generation portion 14. The determination of the control logic is based on the information about the heat loads obtained from the respective heat source units 101, the performance curves or chilled water flow rates in the respective heat source units obtained from the customer equipment database 22, and the performance lowering or the degree of advance of abnormality in the respective heat source units 101 accumulated in the equipment condition database 24. The control logic determined thus is transmitted from the transmitting portion 15 to the monitoring terminals 104 or the unit number control panel 103 through the information communication network 90 so as to change the operating pattern. In such a manner, the operating pattern by which the power consumption or the gas consumption is the lowest is selected in accordance with the heat load on the air conditioner. Thus, it is possible to reduce the operating cost of the heat source units. In this case, the information about the heat loads obtained from the respective heat source units 101 or the operating conditions of the heat source units 101 are stored in the customer operation database 21 as a heat load pattern of the air conditioner of the customer 100. When the heat load pattern is updated periodically, the heat loads of the heat source units 101 can be estimated more accurately. Accordingly, the heat source units 101 can be controlled more properly. In addition, when the pattern of the heat load on the air conditioner is grasped thus, maintenance time can be determined to be the time of a low heat load on the air conditioner if there occurs abnormality in a heat source unit 101 or there occurs necessity of maintenance work due to the advance of deterioration. In addition, it is possible to make operating control to reduce the load ratio of a heat source unit 101 regarded as abnormal, and thereby avoid failure stop before the maintenance work of the heat source unit 101 in question can be carried out.

In such a manner, when a remote central control method for controlling the number of operating units of the air conditioner heat source units 101 properly in accordance with the loads thereon is carried out by the central monitoring unit 10, the service company 1 can charge the customer 100 for the cost including the operating cost of electricity or gas and the maintenance cost in accordance with the operating time of the heat source units 101 or the load on the air conditioner. Thus, the service company 1 can provide comprehensive service as for the operation of the heat source units.

In the aforementioned embodiments, description has been made on the case where absorption chillers/heaters are used as heat source units. However, the present invention may be applied to the case where a compression refrigerator is used as a heat source unit.

The compression refrigerator is a refrigerator using the saturated temperature of refrigerant, which increases at higher pressure. The compression refrigerator is constituted by a compressor, an expansion valve, and heat exchangers installed on the high pressure side and the low pressure side of a cycle separated by the compressor and the expansion valve. Refrigerant steam outgoing from the compressor discharges latent heat of the refrigerant in the high-pressure-side heat exchanger so as to become liquid refrigerant. The liquid refrigerant passes through the expansion value so as to be reduced in pressure. The liquid refrigerant advances to the low-pressure-side heat exchanger, and absorbs latent heat from the outside so as to become refrigerant steam, which is fed to the compressor. When the refrigerator is used as a heat source unit for air conditioning, indoor air, water or brine is introduced into the low-pressure-side heat exchanger so that the heat thereof is absorbed into the refrigerant. Further, the high-pressure-side heat exchanger exchanges heat with outside air or cooling water flowing through a cooling tower.

In the case where water flow using cooling water is carried out or heat exchange with the air is carried out in order to discharge heat to the outside, pollution reduces the heat exchange performance, resulting in the lowering of the performance. When dirt adheres to the heat exchangers, it is necessary to eliminate the dirt, and it is therefore necessary to diagnose the adhesion of dirt. To this end, the refrigerant pressure or temperature in the heat exchanger as a subject of diagnosis, and the temperature of the water or air for performing heat exchange with the refrigerant are measured. Diagnosis can be carried out using the difference in temperature between the refrigerant and the water or air, or the capacity of the heat exchanger.

Such dirt is generally attached with the passage of time. As described in the first embodiment of the present invention, by grasping changes of the heat source units in use, accurate diagnosis can be carried out even if there is an individual difference among the heat source units.

As has been described above, according to the present invention, it is possible to forecast inspection time accurately before the lowering of performance or the occurrence of abnormality in air conditioner heat source units. In addition, since the inspection time can be forecast accurately before the lowering of performance or the occurrence of abnormality in the air conditioner heat source units, maintenance based on accurate forecast can be carried out. Thus, the loss of a user can be suppressed, and further, the cost required for operating the heat source units can be reduced.

What is claimed is:

1. An apparatus for managing at least one heat source unit for an air conditioner, comprising:

means for analyzing cyclic operation condition of said heat source unit from operating data of said heat source unit, said cyclic operation condition having an operating cycle of operation, dilution and stop;

means for averaging said cyclic operation condition for a predetermined period;

means for storing said averaged data into a storage unit in time series;

means for comparing said data stored in time series with analyzed data of current cyclic operation condition obtained by said analyzing means;

means for detecting a variation, with time, in lowering of performance and/or degree of advance of abnormality in said heat source unit on and after start of use of said heat source unit, based on a comparison result produced by said comparing means;

means for estimating degree of deterioration of said heat source unit on and after said start of use based on said variation with time; and means for determining maintenance time from a predetermined deterioration threshold value and said estimated degree of deterioration.

2. An apparatus for managing at least one heat source unit for an air conditioner, comprising:

means for estimating temperatures of respective portions of said heat source unit in a substantially stable condition after operation, based on one of a temperature history during start-up of said heat source unit and a temperature history during stop of said heat source unit;

means for averaging temperature in cyclic operation condition of said heat source unit for a predetermined period, said cyclic operation condition having an operating cycle of operation, dilution and stop;

means for storing said averaged temperature data into a storage unit in time series;

means for comparing said temperature data stored in time series with said temperature data of said respective portions estimated by said estimating means;

means for detecting a variation, with time, in lowering of performance and/or degree of advance of abnormality in said heat source unit on and after start of use of said heat source unit, based on a comparison result produced by said comparing means;

means for estimating degree of deterioration of said heat source unit on and after said start of use based on said variation with time; and means for determining maintenance time from a predetermined deterioration threshold value and said estimated degree of deterioration.

3. An apparatus for managing at least one heat source unit for an air conditioner, comprising:

a central monitoring unit connected to said heat source unit for said air conditioner through an information communication network and for carrying out remote central control upon said heat source unit for said air conditioner; wherein:

said central monitoring unit includes a control unit for managing said heat source unit for said air conditioner; and said control unit includes:

means for analyzing cyclic operation condition of said heat source unit from operating data of said heat source unit transmitted through said information communication network, said cyclic operation condition having an operating cycle of operation, dilution and stop;

means for averaging said cyclic operation condition for a predetermined period;

means for storing said averaged data into a storage unit in time series;

means for comparing said data stored in time series with analyzed data of current cyclic operation condition obtained by said analyzing means;

means for detecting a variation, with time, in lowering of performance and/or degree of advance of abnormality in said heat source unit on and after start of use of said heat source unit, based on a comparison result between said stored data and said analyzed data;

means for estimating degree of deterioration of said heat source unit on and after said start of use based on said variation with time; and means for determining maintenance time from a predetermined deterioration threshold value and said estimated degree of deterioration.

4. An apparatus for managing at least one heat source unit for an air conditioner, comprising:

a central monitoring unit connected to said heat source unit for said air conditioner through an information communication network and for carrying out remote central control upon said heat source unit for said air conditioner; wherein:

said central monitoring unit includes a control unit for managing said heat source unit for said air conditioner; and said control unit includes:

means for estimating temperatures of respective portions of said heat source unit in operation based on one of a temperature history during start-up of said heat source unit and a temperature history during stop of said heat source unit, said temperature histories being transmitted through said information communication network;

means for averaging temperature in cyclic operation condition of said heat source unit for a predetermined period, said cyclic operation condition having an operating cycle of operation, dilution and stop;

means for storing said averaged temperature data into a storage unit in time series;

means for comparing said temperature data stored in time series with said temperature data of said respective portions estimated by said estimating means;

means for detecting a variation, with time, in lowering of performance and/or degree of advance of abnormality in said heat source unit on and after start of use of said heat source unit, based on a comparison result between said stored temperature data and said estimated temperature data;

means for estimating degree of deterioration of said heat source unit on and after said start of use based on said variation with time; and means for determining maintenance time from a predetermined deterioration threshold value and said estimated degree of deterioration.

5. An apparatus for managing at least one heat source unit for an air conditioner according to any one of claims 1 to 4, further comprising:

means for comparing a temperature history during operation of said heat source unit with a pattern of a temperature history during occurrence of abnormality stored in said storage unit in advance, so as to conduct diagnosis on abnormal condition of said heat source unit.

6. An apparatus for managing at least one heat source unit for an air conditioner according to any one of claims 1 to 4, further comprising:

means for changing control logic concerning start and stop of said heat source unit in accordance with said degree of deterioration estimated by said means for estimating said degree of deterioration on and after said start of use based on said variation with time.

7. An apparatus for managing at least one heat source unit for an air conditioner according to any one of claims 1 to 4, further comprising:

means for changing control logic concerning start and stop of said heat source unit in accordance with said degree of deterioration estimated by said means for estimating said degree of deterioration on and after said start of use based on said variation with time;

wherein said means for changing said control logic selects control logic for stopping said heat source unit when said heat source unit is diagnosed as abnormal.

8. An apparatus for managing at least one heat source unit for an air conditioner according to any one of claims 1 to 4, further comprising:

means for changing control logic concerning start and stop of said heat source unit in accordance with said degree of deterioration estimated by said means for estimating said degree of deterioration on and after said start of use based on said variation with time;

wherein when said heat source unit is diagnosed as abnormal, said means for changing said control logic selects control logic to prevent abnormality from occurring in other portions due to said diagnosed abnormality of said heat source unit.

9. An apparatus for managing at least one heat source unit for an air conditioner according to any one of claims 1 to 4, further comprising:

means for calculating real heat load on said air conditioner connected to said heat source unit, based on analytic data analyzed by said analyzing means;

means for storing, into a storage unit, time-series data of said heat load on said air conditioner connected to said heat source unit;

means for comparing said stored time-series data with current data, and judging whether a difference between said stored time-series data and said current data is permanent or not; and means for correcting and updating a pattern of said heat load to thereby estimate future heat load when said judging means concludes that said difference is permanent.

10. An apparatus for managing at least one heat source unit for an air conditioner according to any one of claims 1 to 4, wherein a plurality of heat source units are provided as said at least one heat source unit.

11. An apparatus for managing at least one heat source unit for an air conditioner according to claim 10, further comprising:

means for operating a heat source unit having a smaller degree of deterioration by priority based on said future heat load estimated by said means for estimating said heat load.

12. A method for managing at least one heat source unit for an air conditioner, comprising the steps of:

analyzing cyclic operation condition of said heat source unit from at least one piece of operating data of said heat source unit, said cyclic operation condition having an operating cycle of operation, dilution and stop;

averaging said cyclic operation condition for a predetermined period;

storing said averaged data into a storage unit in time series;

comparing said data stored in time series with analyzed data of current cyclic operation condition obtained by said analyzing step;

detecting a variation, with time, in lowering of performance and/or degree of advance of abnormality in said heat source unit on and after start of use of said heat source unit, based on a comparison result between said stored data and said analyzed data;

estimating degree of deterioration of said heat source unit on and after said start of use based on said variation with time; and determining maintenance time from a predetermined deterioration threshold value and said estimated degree of deterioration.

13. A method for managing at least one heat source unit for an air conditioner, in which a central monitoring unit is connected to said heat source unit for said air conditioner through an information communication network and carries out remote central control upon said heat source unit for said air conditioner, comprising the steps of:

analyzing cyclic operation condition of said heat source unit from operating data of said heat source unit transmitted through said information communication network, said cyclic operation condition having an operating cycle of operation, dilution and stop;

averaging said cyclic operation condition for a predetermined period;

storing said averaged data into a storage unit in time series;

comparing said data stored in time series with analyzed data of current cyclic operation condition obtained by said analyzing step;

detecting a variation, with time, in at least one of lowering of performance and degree of advance of abnormality in said heat source unit on and after start of use of said heat source unit, based on a comparison result between said stored data and said analyzed data;

estimating degree of deterioration of said heat source unit on and after said start of use based on said variation with time; and determining maintenance time from a predetermined deterioration threshold value and said estimated degree of deterioration.

14. A method for managing at least one heat source unit for an air conditioner according to claim 12 or 13, wherein said cyclic operation condition is a temperature condition.

15. A method for managing at least one heat source unit for an air conditioner according to claim 12 or 13, wherein a plurality of heat source units are provided as said at least one heat source unit.

* * * * *